United States Patent [19]

Lee

[11] Patent Number: 4,961,272

[45] Date of Patent: Oct. 9, 1990

[54] DRYING APPARATUS

[76] Inventor: Shih-Ye Lee, No. 19-2, Ssu-Wei St., Hsueh-Chia Chen, Tainan Hsien, Taiwan

[21] Appl. No.: 450,833

[22] Filed: Dec. 12, 1989

[51] Int. Cl.[5] ..... F26B 19/00

[52] U.S. Cl. ..... 34/90; 34/202; 34/239; 392/380

[58] Field of Search ..... 34/90, 91, 201, 202, 34/243 R, 239, 233; 219/366, 369, 370, 371, 217, 373, 374, 262, 353; 4/597

[56] References Cited

U.S. PATENT DOCUMENTS

| | | | |
|---|---|---|---|
| 3,128,161 | 4/1964 | Hudon | 34/233 |
| 3,449,838 | 6/1969 | Chancellor, Jr. | 34/90 |
| 3,587,118 | 6/1971 | Compton | 34/597 |
| 3,621,199 | 11/1971 | Goldstein | 219/370 |
| 3,711,958 | 1/1973 | Lepage | 34/239 |
| 3,878,621 | 4/1975 | Duerre | 34/90 |
| 4,594,797 | 6/1986 | Houck, Jr. | 34/243 R |
| 4,682,424 | 7/1987 | Irving | 34/202 |
| 4,756,094 | 7/1988 | Houck, Jr. | 34/233 |
| 4,780,595 | 10/1988 | Alban | 219/370 |
| 4,871,900 | 10/1989 | Hickman | 34/202 |

*Primary Examiner*—Henry A. Bennet
*Assistant Examiner*—Denise L. Ferensic
*Attorney, Agent, or Firm*—Ladas & Parry

[57] ABSTRACT

A drying apparatus includes a vertical housing having a generally horizontal base portion, a generally vertical intermediate portion and a generally horizontal top portion which together define a drying space therebetween. The user can stand on the base portion of the housing in the drying space. The base portion, the intermediate portion and the top portion of the housing are each equipped with a hot-air blowing unit which consists of a fan and a heating element. A control switch unit can selectively activate some or all of the fans and the heating elements so as to blow hot or cold air over the hair and/or the upper part and/or the lower part of the body of the user. A water guiding device guides the water in the upper surface of the base portion of the housing to flow from the user to one or more selected places so as to prevent downward flowing water from damaging the hot-air blowing unit in the base portion.

5 Claims, 4 Drawing Sheets

DRYING APPARATUS

BACKGROUND OF THE INVENTION

This invention relates to a drying apparatus which can blow hot air over the entire body of the user.

When a person dries his or her wet body using a towel in a public area, such as a hotel, he or she always worries about the hygienic condition thereof. Thus, most people usually carry a towel from their home based on consideration of hygienics. This towel forms a load for the carrier, especially for the person who takes a trip on business or holiday.

SUMMARY OF THE INVENTION

It is the main object of this invention to provide a drying apparatus which can blow hot air over the entire body of the user.

According to this invention, a drying apparatus includes a vertical housing, a fan device, a heating device, a control switch unit and a water guiding device. The vertical housing has a generally horizontal base portion with a top wall, a generally vertical intermediate portion with an inward wall, and a generally horizontal top portion with a bottom wall. The top wall of the base portion, the bottom wall of the top portion and the inward wall of the intermediate portion together define a drying space in which the user can stand on the base portion. The fan device includes three fans respectively installed in the top portion, the intermediate portion and the base portion of the housing. These fans blow air to the drying space. The heating device includes three heating elements which are respectively interposed between the fans and the drying space, so as to heat the air which is transmitted from the fans to the drying space. The control switch unit selectively supplies electric power to some or all of the fans and the heating elements so as to dry the hair and/or the upper part and/or the lower part of the body of the user with cold or hot air. Because the water guiding device is disposed on the upper surface of the base portion of the housing so as to guide water from the user to flow to one or more selected places, the fan and the heating element in the base portion of the housing can fully incorporate blowing hot air to the user who stands on said base portion of said housing.

In one embodiment, the water guiding device includes an essentially corrugated plate placed on the base portion of the housing and having a plurality of peak portions, a plurality of slots formed in said peak portions of said corrugated plate, a plurality of water shielding plates fixed on said corrugated plate above said slots so as to prevent downward flowing water from entering said slots, and a net plate placed on said corrugated plate so that the user can stand thereon.

BRIEF DESCRIPTION OF THE DRAWING

Other features and advantages of this invention will become apparent in the following detailed description of a preferred embodiment of this invention, with reference to the accompanying drawings in which.

DETAILED DESCRIPTION OF THE PREFERRED EMBODIMENT

Figure 1:
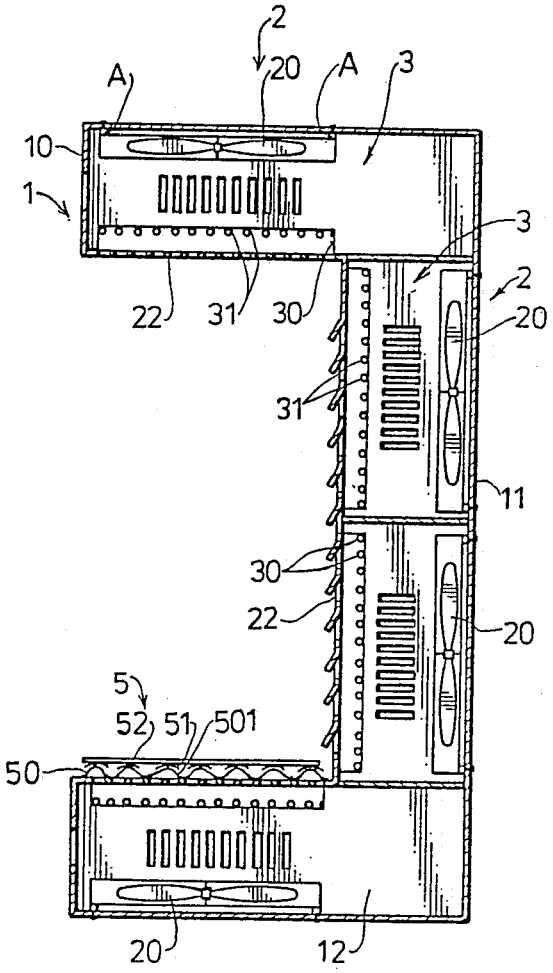
FIG. 1 is an elevated view of a drying apparatus according to this invention.
Figure 2:
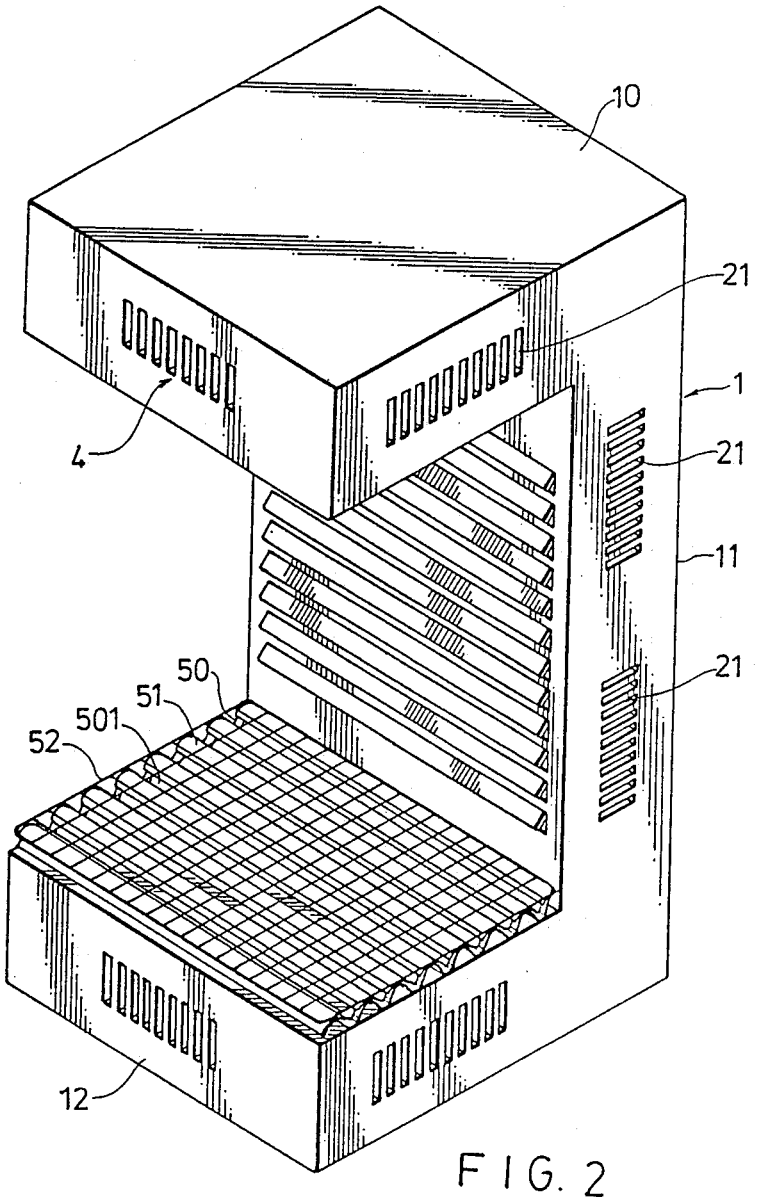
FIG. 2 is a perspective view showing the drying apparatus of this invention.

Referring to FIGS. 1 and 2, a drying apparatus of this invention includes a vertical housing 1, a fan device 2, a heating device 3, a control switch unit 4 and a water guiding device 5.

Figure 4:
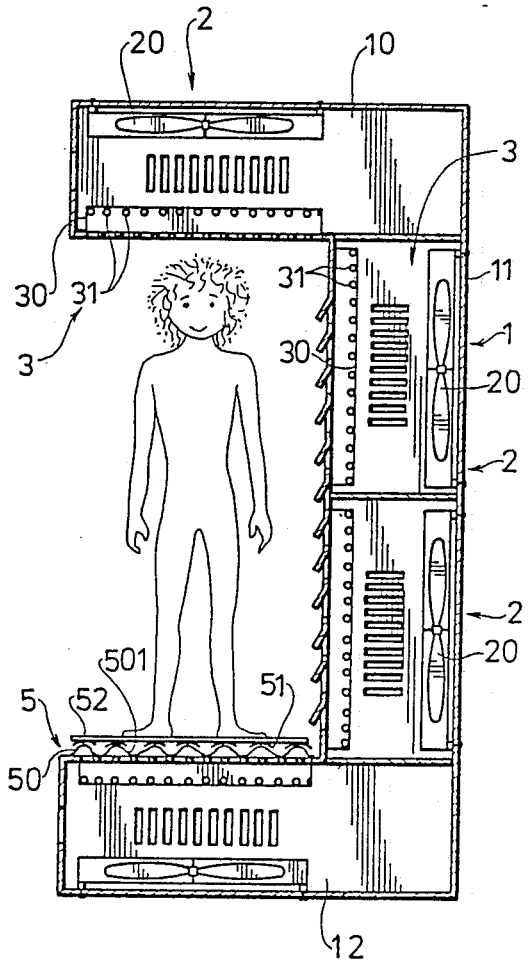
FIG. 4 is a schematic view illustrating the use of the drying apparatus according to this invention.

The housing 1 has a substantially horizontal top portion 10, a substantially vertical intermediate portion 11 and a substantially horizontal base portion 12 between which a drying space is defined. As shown in FIG. 4, the housing 1 is sized so that the user can stand on the base portion 12 and under the top portion 10 of the housing 1 in the drying space.

The fan device 2 includes four fans 20 with fan housings fixed in the housing 1 by bolts (A). The housing 1 has a plurality of air inlets 21 formed in the side walls thereof, and a plurality of air outlets 22 formed in the bottom wall of the top portion 10, the inward wall of the intermediate portion 11 and the top wall of the base portion 12. Air can be sucked into the housing 1 through the air inlets 21 and can be exhausted from the housing 1 through the air outlets 22 by the fans 20.

The heating device 3 includes four net racks 30 interposed between the fans 20 and the air outlets 22 in the housing 1, and a plurality of electric heating wires 31 fixed on the racks 30.

As illustrated, the fans 20, the racks 30 and the electric heating wires 31 constitute four hot-air blowing units, the first one being positioned in the top portion 10 of the housing 1, the second one being positioned in the base portion 12 of the housing 1, and another two being positioned in the intermediate portion 11 of the housing 1. The control switch unit 4 operatively connects the fans 20 and the electric heating wires 31 to a power supply by electric cords so as to activate some or all of the fans 20 and the electric heating wires 31, thereby drying the hair and/or the upper part and/or the lower part of the user by hot or cold air.

Figure 3:
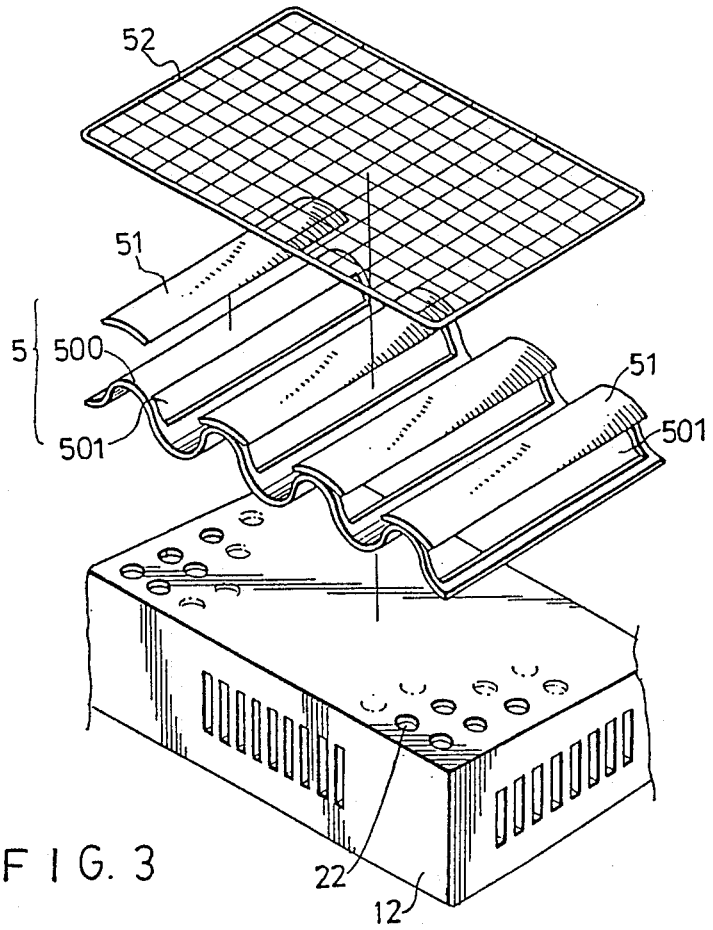
FIG. 3 is an exploded view showing the water guiding device of the drying apparatus according to this invention.

Referring to FIG. 3, the water guiding device 5 includes an essentially corrugated plate 50 placed on the base portion 12 of the housing 1, and a net plate 52 placed on the corrugated plate 50 so that the user can stand on the net plate 52. The corrugated plate 50 includes a plurality of peak portions 501 each of which has two slots 502 (only on is shown) formed in two sides thereof. A plurality of parallel water shielding plates 51 are fixed on the tips of the peak portions 501 of the corrugated plate 5 so as to prevent downward flowing water from entering the slots 502 of the corrugated plate 5. This entrance of water into the slots 502 results in the damage to the hot-air blowing unit in the base portion 12 of the housing 1.

With this invention thus explained, it is apparent that numerous modifications and variations can be made without departing from the scope and spirit of this invention. It is therefore intended that this invention be limited only as indicated in the appended claims.

I claim:

1. A body drying apparatus comprising:

a vertical housing, having a generally horizontal base portion with a top wall, a generally vertical intermediate portion with an inward wall, and a generally horizontal top portion with a bottom wall, said top wall of said base portion and said bottom wall of said top portion and said inward wall of said intermediate portion together defining a drying space in which a user can stand on said base portion;

a fan device including three fans respectively installed in said top portion, said intermediate portion and said base portion of said housing, said fans blowing air to said drying space;

a heating device including three heating elements which are respectively interposed between said fans and said drying space, so as to heat air which is transmitted from said fans to said drying space; and a control switch unit selectively supplying electric power to some or all of said fans and said heating elements so as to dry hair and/or an upper part and/or a lower part of said body of said user.

2. A drying apparatus as claimed in claim 1, wherein a water guiding device is disposed on an upper surface of said base portion of said housing so as to guide water to flow from the user to one or more selected places, whereby said fan and said heating element in said base portion of said housing can fully incorporate blowing hot air over the user which stands on said base portion of said housing.

3. A drying apparatus as claimed in claim 2, wherein said water guiding device includes an essentially corrugated plate placed on said base portion of said housing and having a plurality of peak portions, a plurality of slots formed in said peak portions of said corrugated plate, a plurality of water shielding plates fixed on said corrugated plate above said slots so as to prevent downward flowing water from entering said slots, and a net plate placed on said corrugated plate so that the user can stand thereon.

4. A drying apparatus as claimed in claim 1, wherein said housing has a plurality of air outlets respectively formed in said top wall of said base portion, said inward wall of said intermediate portion and said bottom wall of said top portion of said housing, and a plurality of air inlets respectively formed in other walls of said base portion, said intermediate portion and said top portion of said housing, whereby, air can be sucked into said housing through said air inlets by said fans and can be exhausted from said housing through said air outlets by said fans.

5. A drying apparatus as claimed in claim 4, wherein said heating device further includes three net racks respectively fixed in said housing between said fans and said air outlets, and said heating elements are electric heating wires secured to said racks.

* * * * *